US008087662B2

(12) United States Patent
Asada et al.

(10) Patent No.: US 8,087,662 B2
(45) Date of Patent: Jan. 3, 2012

(54) SHEET FEEDER AND IMAGE RECORDING APPARATUS

(75) Inventors: Tetsuo Asada, Kuwana (JP); Keisuke Wakakusa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/728,805

(22) Filed: Mar. 22, 2010

(65) Prior Publication Data

US 2011/0074092 A1 Mar. 31, 2011

(30) Foreign Application Priority Data

Sep. 30, 2009 (JP) ..... 2009-227261

(51) Int. Cl.
*B65H 3/34* (2006.01)
*B65H 3/52* (2006.01)

(52) U.S. Cl. ..... 271/121; 271/167

(58) Field of Classification Search ..... 271/121, 271/167, 137

See application file for complete search history.

(56) References Cited

U.S. PATENT DOCUMENTS

| | | | | |
|---|---|---|---|---|
| 6,139,007 | A | 10/2000 | Cahill et al. | |
| 6,279,897 | B1 | 8/2001 | Richards | |
| 6,712,351 | B2 * | 3/2004 | Hsieh | 271/121 |
| 7,690,645 | B2 * | 4/2010 | Koga | 271/167 |
| 7,852,526 | B2 * | 12/2010 | Mo et al. | 358/498 |
| 2002/0163117 | A1 * | 11/2002 | Hsieh | 271/121 |
| 2004/0026845 | A1 | 2/2004 | Park | |
| 2005/0194734 | A1 * | 9/2005 | Asada et al. | 271/121 |
| 2006/0180992 | A1 | 8/2006 | Asada | |
| 2010/0244372 | A1 | 9/2010 | Wakakusa et al. | |
| 2011/0074093 | A1 | 3/2011 | Asada et al. | |
| 2011/0074094 | A1 | 3/2011 | Asada et al. | |

FOREIGN PATENT DOCUMENTS

| | | | |
|---|---|---|---|
| JP | H07-251955 | A | 10/1995 |
| JP | 2002-137838 | A | 5/2002 |
| JP | 2004-067389 | A | 3/2004 |
| JP | 2005-247550 | A | 9/2005 |
| JP | 2006-182481 | A | 7/2006 |

OTHER PUBLICATIONS

The State Intellectual Property Office of the People'S Republic of China, Notification of First Office Action for Chinese Patent Application No. 201010148862.0 (counterpart to application related to above-captioned patent application), issued Aug. 3, 2011.

* cited by examiner

*Primary Examiner* — Kaitlin Joerger
(74) *Attorney, Agent, or Firm* — Baker Botts L.L.P.

(57) ABSTRACT

A sheet feeder, including: a holding portion for holding sheets; a sheet supply portion; an inclined member disposed downstream of the holding portion and having an inclined surface for guiding each sheet in a sheet feed direction along the inclined surface; a plurality of first separation protrusions provided on and integrally with the inclined member and arranged in the sheet feed direction, each first separation protrusion protruding from the inclined surface such that its distal end is located more downstream in the sheet feed direction than its proximal end; and a plurality of second separation protrusions formed of a metal, each second separation protrusion protruding from the inclined surface through a corresponding one of openings formed in the inclined member at a position in the sheet feed direction between corresponding adjacent two of the first separation protrusions, the second separation protrusions being arranged in the sheet feed direction.

12 Claims, 5 Drawing Sheets

SHEET FEEDER AND IMAGE RECORDING APPARATUS

CROSS REFERENCE TO RELATED APPLICATION

The present application claims priority from Japanese Patent Application No. 2009-227261, which was filed on Sep. 30, 2009, the disclosure of which is herein incorporated by reference in its entirety.

BACKGROUND OF THE INVENTION

1. Field of the Invention

The present invention relates to a sheet feeder in which a plurality of sheets which are fed at one time are separated by separation protrusions when the sheets held on a holding portion are fed along a guide member, and an image recording apparatus equipped with such a sheet feeder.

2. Discussion of Related Art

An image recording apparatus such as an ink-jet printer is equipped with a sheet feeder configured to feed recording sheets accommodated in a sheet tray to an image recording portion by a rotational force of a roller. The roller is rotated while being held in contact with an uppermost one of the recording sheets on the sheet tray, whereby the rotational force of the roller is transmitted to the uppermost sheet and the uppermost sheet is fed from the sheet tray. As such a sheet feeder, there is known one having a structure in which metal separation protrusions are provided on an inclined guide surface that is disposed at one end of the sheet tray, for feeding only one of the recording sheets on the sheet tray.

SUMMARY OF THE INVENTION

The separation protrusions described above are formed as follows. A metal plate is punched into a suitable shape, and portions of the metal plate that give the separation protrusions are bent so as to stand from a main body of the metal plate. The separation protrusions are inserted through corresponding windows (openings) formed in a guide plate that provides the inclined guide surface, from the back side of the guide plate, whereby the separation protrusions protrude from the inclined guide surface. The protrusion amount by which each separation protrusion protrudes from the inclined guide surface is determined by considering an ability of the separation protrusions for separating the recording sheets, i.e., the sheet separation ability. The separation protrusions are formed such that portions of one metal plate that give the separation protrusions are cut and bent so as to protrude from the inclined guide surface. Accordingly, there is a limit to a reduction of the pitch at which the separation protrusions are arranged.

It is therefore an object of the invention to provide a sheet feeder in which separation protrusions are arranged at a reduced pitch and an image recording apparatus equipped with such a sheet feeder.

The above-indicated object may be attained according to a principle of the invention, which provides a sheet feeder, comprising:

a holding portion having a holding surface on which a plurality of sheets are held in a stack;

a supply portion configured to supply the plurality of sheets sequentially from an uppermost one of the plurality of sheets held on the holding portion;

an inclined member disposed downstream of the holding portion in a direction in which the sheets are supplied by the supply portion and having an inclined surface that faces a leading edge of each of the sheets held on the holding portion while inclining relative to the holding surface, the inclined member being configured to guide said each of the sheets supplied from the holding portion in a sheet feed direction in which said each of the sheets is fed along the inclined surface;

a plurality of first separation protrusions which are provided on and integrally with the inclined member and each of which protrudes from the inclined surface such that a distal end thereof is located more downstream in the sheet feed direction than a proximal end thereof, the plurality of first separation protrusions being arranged in the sheet feed direction; and a plurality of second separation protrusions which are formed of a metal and each of which protrudes from the inclined surface through a corresponding one of openings that is formed in the inclined member at a position in the sheet feed direction between corresponding adjacent two of the plurality of first separation protrusions, the plurality of second separation protrusions being arranged in the sheet feed direction.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter described one preferred embodiment of the invention with reference to the drawings. It is to be understood that the embodiment described below may be otherwise modified without departing from the scope of the invention defined in the attached claims.

[Internal Structure of Printer 11]

Figure 1:
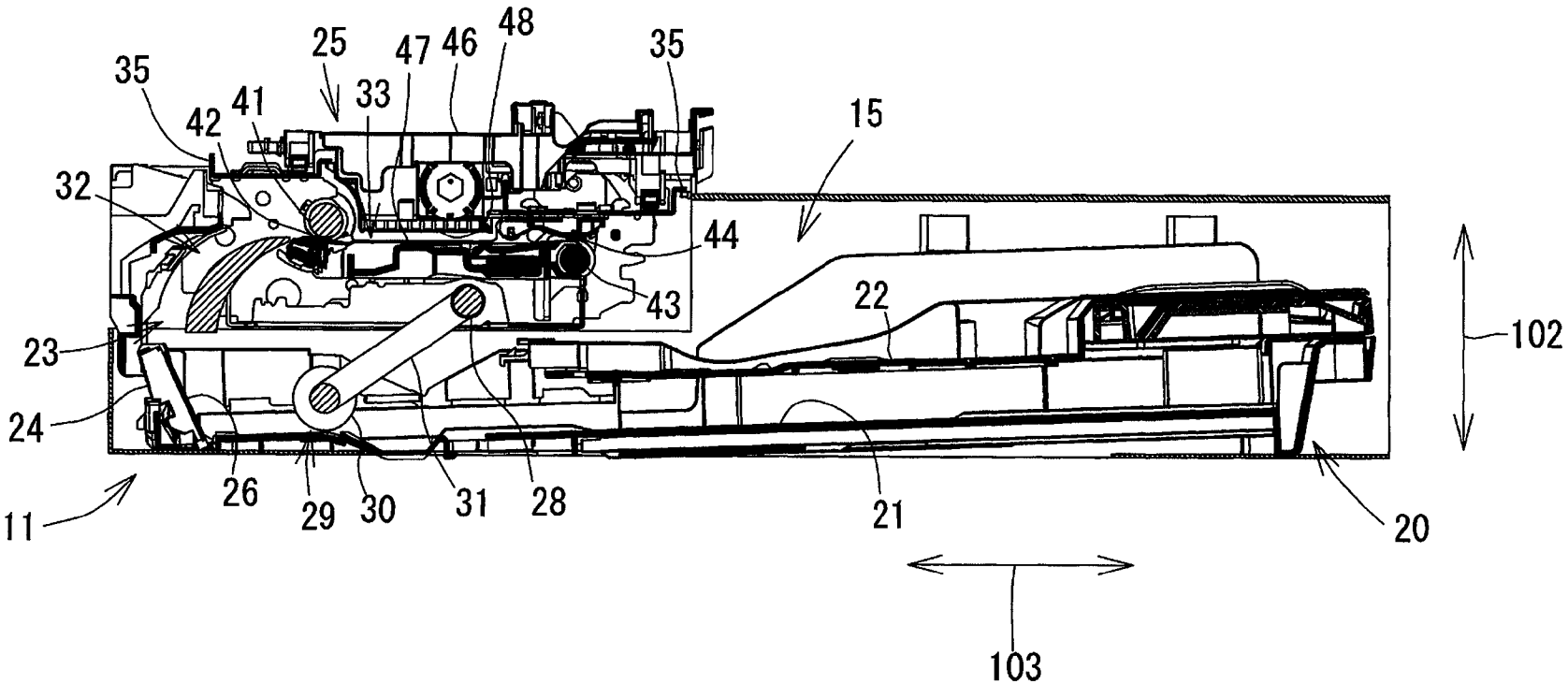
FIG. 1 is a schematic view showing an internal structure of a printer according to one embodiment of the invention.

As shown in FIG. 1, a printer 11 has a sheet transfer path 23 through which each of recording sheets supplied from a sheet cassette 20 is transferred and a recording portion 25 provided in the sheet transfer path 23. In the present embodiment, while the printer 11 will be explained as having only a printing function, the printer 11 may be realized as a multi function device having various functions such as a scanning function, a facsimile function, and a copying function, in addition to the printing function. The printer 11 is an image recording apparatus equipped with a sheet feeder according to the present invention.

In the present embodiment, the directions indicated by arrows 101, 102, 103 in the drawings are a width direction, a height direction, and a depth direction, of the printer 11, respectively. The direction 101 may also be referred to as "a sheet width direction" which is a width direction of each of the recording sheets that is fed. Further, the direction 103 may also be referred to as "a supply direction" in which each of the recording sheets in the sheet cassette 20 is sent.

[Sheet Cassette 20]

As shown in FIG. 1, the sheet cassette 20 is provided so as to be inserted into an inner space 15 of the printer 11 from the front side thereof (the right-hand side in FIG. 1) and withdrawn from the inner space 15 toward the front side, along the depth direction 103. The sheet cassette 20 is a rectangular box whose upper surface is partly open. A plurality of recording sheets are placed or held in a stack on a bottom plate 21 of the sheet cassette 20. The recording sheets placed on the sheet cassette 20 are fed into the sheet transfer path 23 by a sheet supply roller 30. A sheet receiving tray 22 is constituted as a part of the upper surface of the sheet cassette 20. Each of the recording sheets outputted from the sheet transfer path 23 is placed on the sheet receiving tray 22. The sheet cassette 20 is a holding portion, and the upper surface of the bottom plate 21 is a holding surface. Each recording sheet is one example of a sheet.

On the rear side of the sheet cassette 20, there is disposed an inclined member 24 that stands relative to the bottom plate 21. The inclined member 24 is disposed so as to face the leading edge of each of the recording sheets placed on the bottom plate 21 and has a flat plate-like shape extending in the width direction 101. The inclined member 24 is inclined such that its upper end portion is located more downstream than its lower end portion in the sheet feed direction 104. Owing to the inclination of the inclined member 24, an inclined surface 26 with which the leading edge of each of the recording sheets comes into contact is formed so as to face the leading edge of each of the sheets on the bottom plate 21. The upper surface of the bottom plate 21 is substantially horizontal when the sheet cassette 20 is installed on the printer 11. The upper surface of the bottom plate 21 and the inclined surface 26 form a predetermined angle. The inclined member 24 will be explained in detail.

[Sheet Transfer Path 23]

As shown in FIG. 1, the sheet transfer path 23 has a curved portion 32 by which each recording sheet is guided so as to be transferred in a curved form and a straight portion 33 by which the sheet is guided so as to be transferred straight. The curved portion 32 extends upward from the rear side of the sheet cassette 20 (i.e., from the left-hand side in FIG. 1) and is curved toward the front side of the printer 11 (i.e., toward the right-hand side in FIG. 1). The straight portion 33 extends straight from the curved portion 32 toward the front side of the printer 11 near to the sheet receiving tray 22. The recording sheets are supplied from the sheet cassette 20 sequentially to the curved portion 32 and the straight portion 33. The sheet transfer path 23 is a so-called U-turned path constituted by the curved portion 32 and the straight portion 33.

[Supply Portion 29]

As shown in FIG. 1, the supply portion 29 includes a sheet supply roller 30 and an arm 31. The sheet supply roller 30 is pivotably supported at a distal end portion of the arm 31. The arm 31 is pivotable about a pivot axis 28 whose axial direction coincides with the width direction 101. The sheet supply roller 30 is configured to be inserted, by the pivotal movement of the arm 31, into the sheet cassette 20, so as to come into contact with an uppermost one of the recording sheets stacked on the bottom plate 21. The sheet supply roller 30 is rotated by a drive force transmitted from a motor not shown. When the sheet supply roller 30 is rotated while being held in pressing contact with the uppermost one of the sheets stacked on the sheet cassette 20, the uppermost sheet is fed into the sheet transfer path 23 by a frictional force generated between the uppermost sheet and the sheet supply roller 30.

The above-indicated supply portion 29 and sheet cassette 20 constitute a sheet feeder according to the invention.

[Sheet Transfer Mechanism]

A sheet transfer roller 41 and a pinch roller 42 are provided in the straight portion 33 of the sheet transfer path 23. These rollers 41, 42 are disposed on a more upstream side than the recording portion 25 in a direction in which the sheet is transferred. The sheet transfer roller 41 and the pinch roller 42 form a pair. The pinch roller 42 is movable so as to come into contact with and retract from the sheet transfer roller 41, and is biased by a spring for pressing contact with the sheet transfer roller 41. The sheet transfer roller 41 is configured to be rotated by a drive force transmitted from a motor not shown. The recording sheet held by and between the sheet transfer roller 41 and the pinch roller 42 is transferred to the recording portion 25 by the rotation of the sheet transfer roller 41.

A sheet discharge roller 43 and a spur 44 are provided in the straight portion 33 of the sheet transfer path 23. The sheet discharge roller 43 and the spur 44 are disposed on a more downstream side than the recording portion 25 in the direction in which the sheet is transferred. The sheet discharge roller 43 and the spur 44 form a pair. The spur 44 is movable so as to come into contact with and retract from the sheet discharge roller 43, and is biased by a spring for pressing contact with the sheet discharge roller 43. The sheet discharge roller 43 is configured to be rotated by a drive force transmitted from a motor not shown. The rotation of the sheet discharge roller 43 is synchronism with the rotation of the sheet transfer roller 41. The recording sheet held by and between the sheet discharge roller 43 and the spur 44 is transferred to the sheet receiving tray 22 by the rotation of the sheet discharge roller 43.

[Recording Portion 25]

As shown in FIG. 1, the recording portion 25 is disposed on the straight portion 33 of the sheet transfer path 23 and includes a carriage 46 and a platen 47. The carriage 46 is disposed on the upper side of the platen 47 with the straight portion 33 interposed therebetween. A recording head 48 is mounted on the carriage 46. While not shown in FIG. 1, the recording head 48 has nozzles from which ink droplets are ejected. The recording head 48 is mounted on the carriage 46 such that openings of the nozzles are exposed toward the platen 47.

The carriage 46 is configured to reciprocate, together with the recording head 48, in the width direction 101, i.e., in a direction perpendicular to the sheet plane of FIG. 1, by a drive force transmitted thereto from a motor not shown. The carriage 46 is prevented from moving in the depth direction 103 by engagement thereof with a guide rail 35 that extends in the width direction 101.

During the reciprocating movement of the carriage 46 in the width direction 101, minute ink droplets are selectively ejected from the recording head 48 toward the recording sheet on the platen 47. The ejected ink droplets are attached to the recording sheet, whereby an image is recorded on the recording sheet. The ink is supplied from an ink cartridge not shown to the recording head 48. The recording portion 25 is one kind of a recording device.

[Inclined Member 24]

Figure 2:
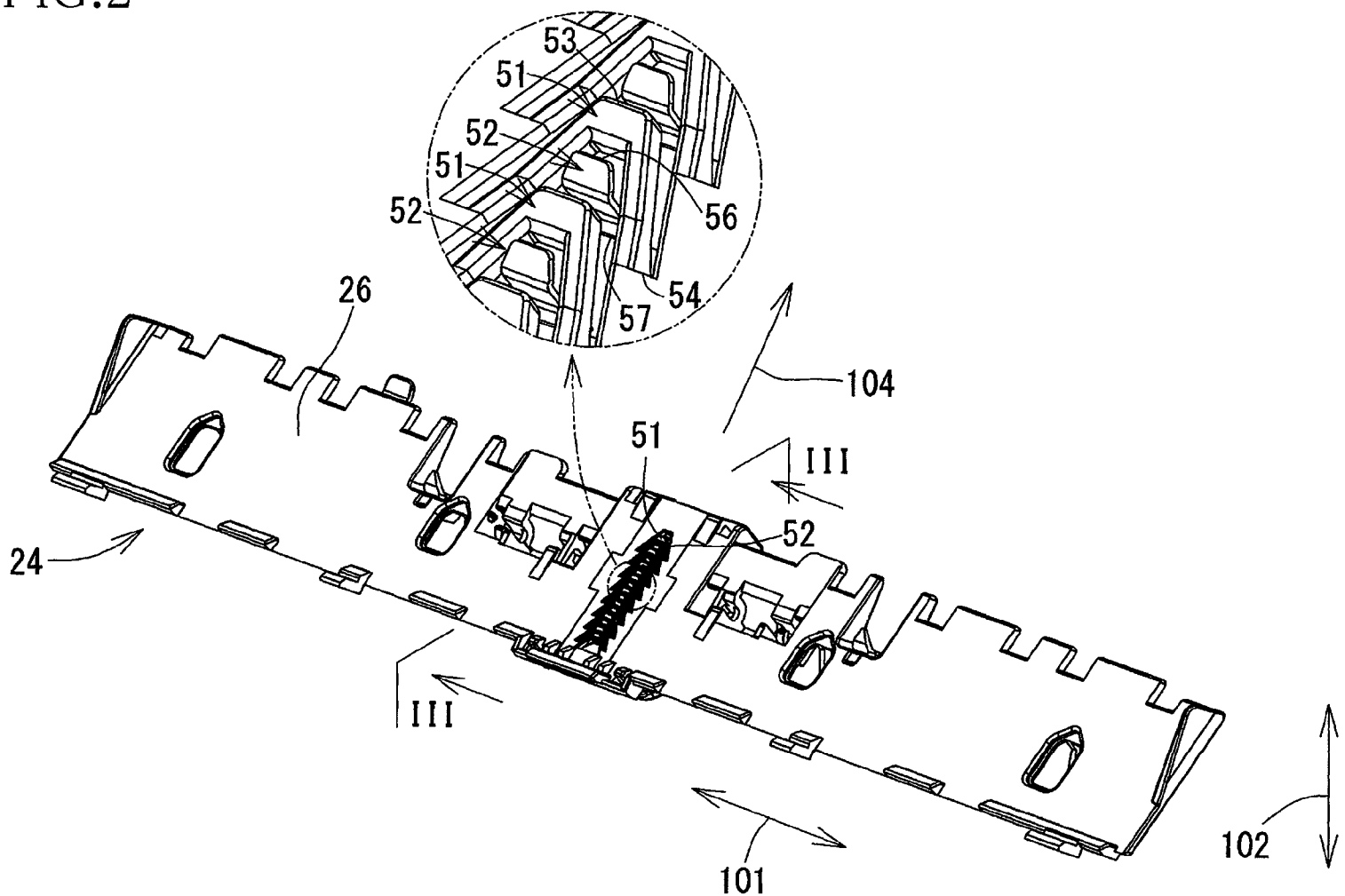
FIG. 2 is a perspective view showing an external appearance of an inclined member on the side of an inclined surface.

As shown in FIG. 2, the inclined member 24 has a flat plate shape that is long in the width direction 101. The dimension of the inclined member 24 as measured in the width direction 101 is made larger than the width of a maximum size of the recording sheet that can be placed on the sheet cassette 20. One of opposite surfaces of the inclined member 24 (shown in FIG. 2) that faces the recording sheets on the sheet cassette 20 is an inclined surface 26. The inclined surface 26 may be a flat plane or a curved plane that is slightly curved along the width direction 101. The inclined surface 26 is configured to contact the leading edge of the recording sheet supplied by the supply portion 29 and to guide the recording sheet slantingly in the upward direction. For smooth guiding of the recording sheet, the inclined surface 26 is formed of a material having a low degree of sliding resistance.

The angle defined by the inclined surface 26 and the upper surface of the bottom plate 21 is determined to be a suitable value that permits the recording sheet to be flexed without stopping for changing the traveling direction of the sheet to the slantingly upward direction, when the recording sheet placed on the bottom plate 21 of the sheet cassette 20 is fed and its leading edge comes into contact with the inclined surface 26. Where the angle defined by the inclined surface 26 and the upper surface of the bottom plate 21 becomes large or becomes close to 90°, namely, where the inclined surface 26 is formed so as to become close to a vertical plane, the recording sheet tends to stop when its leading edge comes into contact with the inclined surface 26, thereby causing a risk of so-called sheet misfeeding or sheet feeding failure in which the recording sheet is not actually fed even though the sheet supply roller 30 operates to feed the sheet. On the other hand, when the angle defined by the inclined surface 26 and the upper surface of the bottom plate 21 becomes small or becomes close to 0°, the height of the inclined surface 26 decreases, resulting in a decrease of the number of the recording sheets that can be placed on the sheet cassette 20. Accordingly, the angle of the inclined surface 26 relative to the bottom plate 21 is suitably set such that the recording sheet can be smoothly guided while taking account of the number of the sheets placed on the sheet cassette 20.

As shown in FIG. 2, there are provided, on the inclined surface 26 of the inclined member 24, first separation protrusions 51 and second separation protrusions 52. The first separation protrusions 51 are formed integrally with the inclined member 24 and are elastically deformable. Where the inclined member 24 is formed of a synthetic resin, for instance, the first separation protrusions 51 are formed integrally with the inclined member 24 by molding. In the present embodiment, a plurality of first separation protrusions 51 are arranged in a row in the sheet feed direction 104 at a position of the inclined surface 26 which is middle in the width direction 101 and which is the same as the position of the sheet supply roller 30 in the width direction 101.

Figure 3:
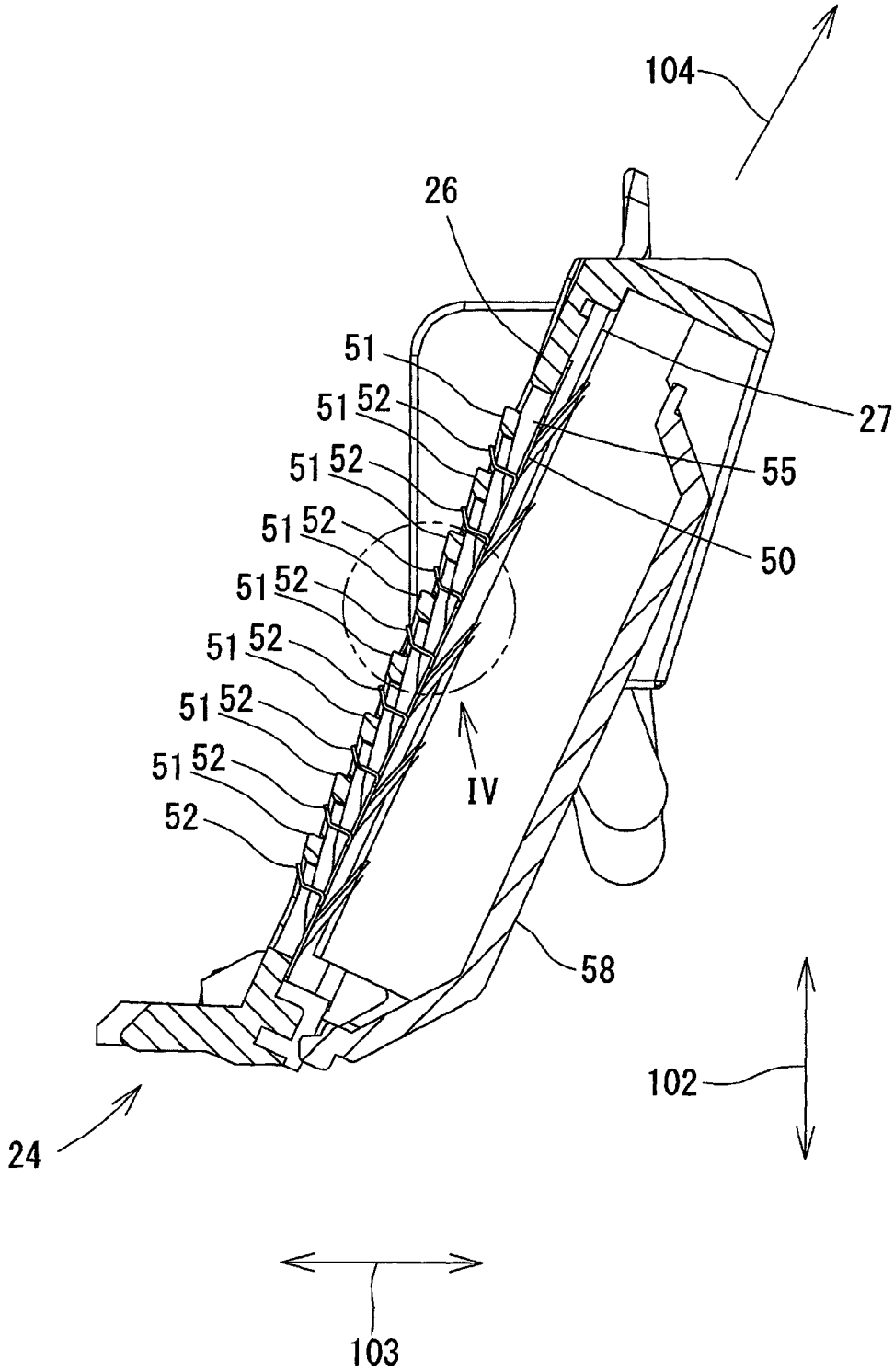
FIG. 3 is a cross-sectional view taken along line III-III in FIG. 2.

Each first separation protrusion 51 protrudes from the inclined surface 26 toward the recording sheets on the bottom plate 21 of the sheet cassette 20 and has two arms at its proximal end 54 that are integrally connected to each other at its distal end 53. As shown in FIG. 3, each first separation protrusion 51 protrudes toward the downstream side in the sheet feed direction 104 slantingly relative to the inclined surface 26. That is, a portion of each first separation protrusion 51 near to the distal end 53 (hereinafter referred to as a "distal-end-side portion" where appropriate) is located more downstream in the sheet feed direction 104 than a portion thereof near to the proximal end 54 (hereinafter referred to as a "proximal-end-side portion" where appropriate). Each first separation protrusion 51 is configured to be elastically deformable so as to fall down toward the inclined surface 26 by being pushed by the recording sheet.

Figure 4:
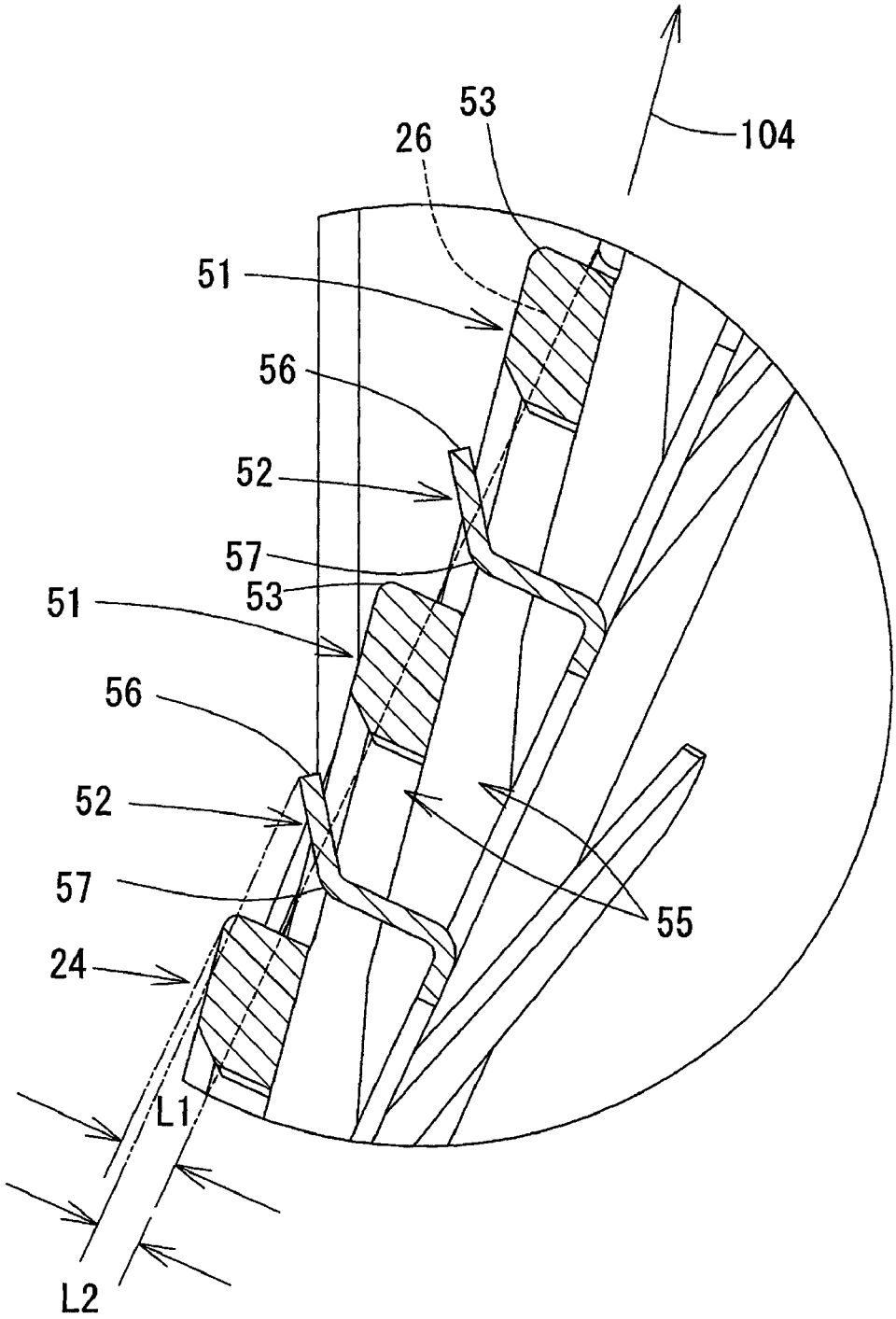
FIG. 4 is an enlarged cross-sectional view of a circled portion indicated by an arrow IV in FIG. 3.

As shown in FIG. 4, the protrusion amount of each first separation protrusion 51 in the sheet feed direction 104 is set such that the distal end 53 of one first separation protrusion 51 is located more downstream in the sheet feed direction 104 than the proximal end 54 of another first separation protrusion 51 that is located adjacent to and immediately downstream of that one first separation protrusion 51 in the sheet feed direction 104. That is, each first separation protrusion 51 is formed such that one first separation protrusion 51 partly overlaps another first separation protrusion 51 located immediately downstream thereof in the sheet feed direction 104, as seen in a direction perpendicular to the inclined surface 26. Accordingly, the distal end 53 of one first separation protrusion 51 is located between the two arms at the proximal end 54 of another first separation protrusion that is located immediately downstream of that one first separation protrusion 51 in the sheet feed direction 104.

As shown in FIG. 2, each first separation protrusion 51 has a tapered shape in which its width dimension as measured in the width direction 101, i.e., a distance from one of the two arms to the other of the two arms, gradually decreases from the proximal end 54 toward the distal end 53. In other words, each first separation protrusion 51 has a trapezoidal shape in which the width dimension at the distal end 53 is smaller than that at the proximal end 54, as seen in the direction perpendicular to the inclined surface 26. As shown in FIG. 4, the corner portions at the distal end 53 of each first separation protrusion 51 nearer to the recording sheets on the bottom plate 21 are rounded so as to have a curved surface. Further, each first separation protrusion 51 is formed such that an angle defined by the distal-end-side portion thereof and the inclined surface 26 is made larger than an angle defined by the proximal-end-side portion thereof and the inclined surface 26. In other words, each first separation protrusion 51 is bent so as to rise from the inclined surface 26, in the direction of protrusion of the first separation protrusion 51 from the proximal end 54 to the distal end 53.

As shown in FIG. 4, the inclined member 24 has through-holes 55 into each of which at least a part of a corresponding one of the first separation protrusions 51 is pushed down, which part is near to the proximal end 54. Each through-hole 55 is a space that is contiguous to a space between the two arms of each first separation protrusion 51. The proximal-end-side portion of each first separation protrusion 51 is accommodated into a corresponding one of the through-holes 55 when each first separation protrusion 51 is elastically deformed so as to fall down toward the inclined surface 26. Each of the second separation protrusions 52 protrudes from the inclined surface 26 toward the recording sheets on the bottom plate 21 of the sheet cassette 20 through a corresponding one of the through-holes 55. Each through-hole 55 is an opening of the present invention. In the present embodiment, the through-holes 55 are contiguous to each other. Accordingly, it may be considered there is formed, in the inclined member 24, a single through-hole into which elastically deformed first separation protrusions 51 are partially accommodated and through which the second separation protrusions 52 protrude.

As shown in FIG. 2, the second separation protrusions 52 are provided on the inclined surface 26 of the inclined member 24 such that each second separation protrusion 52 protrudes from the inclined surface 26 between corresponding adjacent two first separation protrusions 51. The second separation protrusions 52 are disposed so as to be arranged in one row in the sheet feed direction 104, together with the first separation protrusions 51, at the middle position of the inclined surface 26 in the width direction 101.

As shown in FIGS. 3 and 4, the second separation protrusions 52 are provided by a metal spring plate member 50 that is prepared separately from the inclined member 24. The spring plate member 50 is formed by punching and bending of a metal plate. A plurality of protruding portions are formed by punching and bending, at a middle position of the spring plate member 50 in the width direction 101. Each protruding portion stands from a main body of the spring plate member 50 toward the inclined member 24 and is inserted through a corresponding one of the through-holes 55, so as to protrude toward the downstream side in the sheet feed direction 104 slantingly relative to the inclined surface 26. According to the arrangement, the protruding portions function as the second separation protrusions 52. A portion of each second separation protrusion 52 near to its distal end 56 is located more downstream in the sheet feed direction 104 than a portion thereof near to its proximal end 57. Each second separation protrusion 52 is configured to be elastically deformable so as to fall down toward the inclined surface 26 by being pushed by the recording sheet.

As shown in FIG. 3, a cover 58 by which the spring plate member 50 is fixed to the inclined member 24 is attached to a back surface 27 of the inclined member 24 opposite to the inclined surface 26, at a middle position of the back surface 27 in the width direction 101, i.e., in a direction perpendicular to the sheet plane of FIG. 3. The cover 58 has a dimension as measured in the width direction 101 that permits the spring plate member 50 to be completely covered. In a state in which the cover 58 is attached to the inclined member 24, the spring plate member 50 is slightly elastically deformed. The spring plate member 50 undergoes a force to restore its elastic deformation, whereby the second separation protrusions 52 are biased in a direction in which the second separation protrusions 52 protrude through the respective through-holes 55.

As shown in FIG. 4, a protrusion amount L2 by which each second separation protrusion 52 protrudes from the inclined surface 26 in the direction perpendicular to the inclined surface 26 is smaller than a protrusion amount L1 by which each first separation protrusion 51 protrudes from the inclined surface 26 in the same direction. The second separation protrusions 52 are formed by punching of one spring plate member (50) and by bending the portions of the spring plate member (50) that give the second separation protrusions 52 so as to stand from the main body of the spring plate member (50). Accordingly, a distance between the proximal end 57 of one second separation protrusion 52 and the proximal end 57 of another second separation protrusion 52 that is located adjacent to and immediately downstream of the one second separation protrusion 52 in the sheet feed direction 104 is larger than a dimension of each second separation protrusion 52 from the proximal end 57 to the distal end 56.

[Separation of Recording Sheets]

The recording sheets are inserted onto the bottom plate 21 of the sheet cassette 20 from the front side of the printer 11. The inserted recording sheets slide on the bottom plate 21, so that the leading edges of the recording sheets come into contact with the inclined surface 26. When the recording sheets are loaded onto the sheet cassette 20 with a great force, the leading edges of the sheets tend to move in the slantingly upward direction along the inclined surface 26. However, the leading edges of the sheets are prevented from jumping out of the sheet cassette 20 by contacting at least one of the first separation protrusions 51 and the second separation protrusions 52.

When the supply portion 29 operates, the uppermost one of the sheets stacked on the bottom plate 21 of the sheet cassette 20 is fed in the sheet feed direction 104 by the rotation of the sheet supply roller 30. On this occasion, the recording sheets under the uppermost sheet are sometimes fed in the sheet feed direction 104 together with the uppermost sheet, due to the friction, the static electricity, generated between the sheets, or the like. The leading edges of the thus fed recording sheets come into contact with at least one of the separation protrusions 51, 52 when the sheets are guided in the slantingly upward direction along the inclined surface 26.

The recording sheets are further moved or fed in the sheet feed direction 104 such that the leading edges thereof slide on some of the separation protrusions 51, 52. Each of the first and second separation protrusion 51, 52 exhibits a braking action to hinder the feeding of the recording sheets in the sheet feed direction 104 owing to the inclinations thereof. According to the arrangement, the braking action of each of the separation protrusions 51, 52 works on the recording sheets which are fed in the sheet feed direction 104 by a smaller force, namely, the recording sheets other than the uppermost sheet contacting the sheet supply roller 30, among the recording sheets to come into sliding contact with the separation protrusions 51, 52.

In an instance where the recording sheets other than the uppermost sheet cannot be completely stopped in spite of the above-described braking action of one first separation protrusion 51 or one second separation protrusion 52 on which the sheets have slid, and pass over that one first or second separation protrusion 51, 52 after all, the recording sheets subsequently come into contact with next first or second separation protrusion 51, 52 that is disposed immediately downstream of that one first or second separation protrusion 51, 52 in the sheet feed direction 104. In particular, the first separation protrusions 51 are provided on the inclined surface 26 such that any adjacent two first separation protrusions 51 partly overlap each other in the sheet feed direction 104 as described above. Accordingly, the leading edges of the recording sheets come into contact with the next first separation protrusion 51 without contacting the inclined surface 26 after having passed over that one first separation protrusion 51. Thus, the above-described braking action is always exhibited, with respect to the recording sheets, between any adjacent two first separation protrusions 51.

Unlike the first separation protrusions 51, the second separation protrusions 52 do not overlap each other. However, when the leading edges of the recording sheets reach the next second separation protrusion 52 located immediately downstream of the one second separation protrusion 52 over which the leading edges of the recording sheets have passed, the above-described braking action is similarly exhibited. In the present embodiment, in particular, every time when the leading edges of the recording sheets pass over each first separation protrusion 51, the recording sheets repeatedly undergo the braking action, whereby the leading edges of the recording sheets are separated.

In the illustrated embodiment, each of the second separation protrusions 52 formed of a metal protrudes from the inclined surface 26 by a desired amount while the first separation protrusions 51 are disposed such that one first separation protrusion 51 is disposed between corresponding adjacent two of the second separation protrusions 52. Accordingly, it is possible to improve the separation ability to separate the recording sheets supplied from the sheet cassette 20.

In the illustrated embodiment, the first separation protrusions 51 are formed integrally with the inclined member 24 formed of a synthetic resin. Accordingly, each of the recording sheets is prevented from being damaged when the sheet slides on the first separation protrusions 51. The second separation protrusions 52 formed of a metal have a high degree of durability with respect to the sliding contact with the recording sheet, ensuring stabilized sheet separation ability for a long period of time.

Each of the first separation protrusions 51 is formed such that the distal end 53 of one first separation protrusion 51 is located more downstream in the sheet feed direction 104 than the proximal end 54 of another first separation protrusion 51 that is located immediately downstream of that one first separation protrusion 51 in the sheet feed direction 104. Accordingly, the sheet separation ability can be improved by decreasing distances between any adjacent two first separation protrusions 51, thereby enhancing the ability of the first separation protrusions 51 for preventing multiple sheet feeding.

The protrusion amount L2 by which each second separation protrusion 52 protrudes from the inclined surface 26 is made smaller than the protrusion amount L1 by which each first separation protrusion 51 protrudes from the inclined surface 26, whereby the recording surface of each of the recording sheets that are fed along the inclined surface 26 slides mainly on the first separation protrusions 51 and is hard to contact the second separation protrusions 52. The arrangement reduces a risk that the recording surface of each recording sheet is damaged when the sheet supplied from the sheet cassette 20 is fed along the inclined surface 26.

Modified Embodiment

Figure 5:
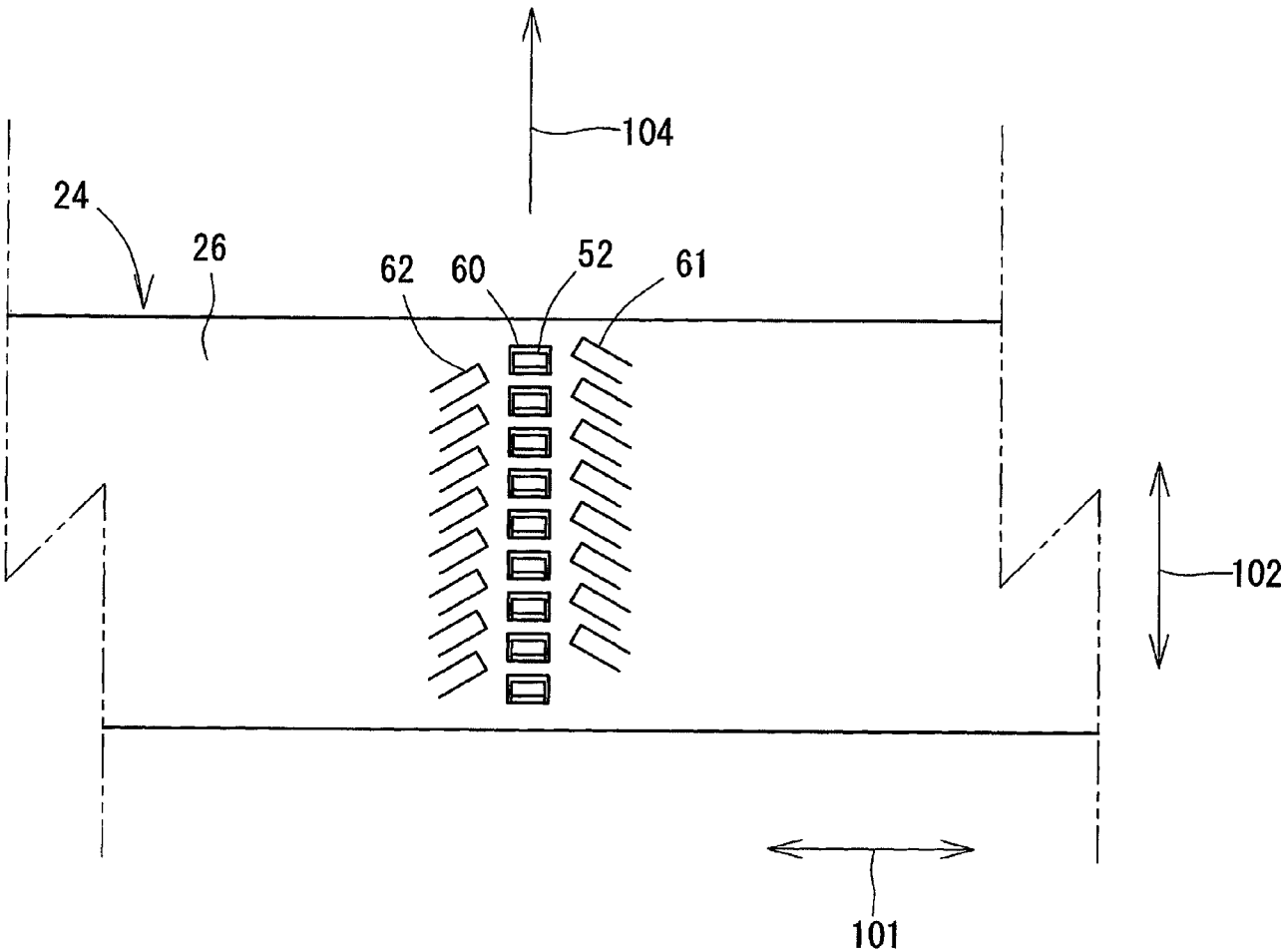
FIG. 5 is a schematic view showing an inclined member according to a modified embodiment.

There will be next explained a modified embodiment with reference to FIG. 5. This modified embodiment is substantially identical in construction with the illustrated embodiment of FIGS. 1-4 except for the layout of the first separation protrusions 51 on the inclined surface 26 and the configuration of the first separation protrusions 51. Accordingly, the following explanation will be made focusing on only the layout and the configuration of the first separation protrusions 51.

As shown in FIG. 5, a plurality of through-holes 60 are formed at a middle position of the inclined surface 26 of the inclined member 24 in the width direction 101, so as to be arranged in a row along the sheet feed direction 104. Each of the through-holes 60 is formed through the thickness of the inclined member 24. The second separation protrusions 52 protrude from the inclined surface toward the recording sheets on the bottom plate 21 through the respective through-holes 60.

On opposite sides of the row of the second separation protrusions 52 in the width direction 101, first separation protrusions 61, 62 are provided. While the reference numerals are partly omitted in FIG. 5, the first separation protrusions 61 are disposed on the right side of the row of the second separation protrusions 52 so as to be arranged in one row along the sheet feed direction 104 while the first separation protrusions 62 are disposed on the left side of the row of the second separation protrusions 52 so as to be arranged in one row along the sheet feed direction 104. Each of the first separation protrusions 61, 62 is constituted by one arm extending from its proximal-end-side portion. The arm of each first separation protrusion 61 and the arm of each first separation protrusion 62 protrude slantingly from the inclined surface 26 toward the downstream side in the sheet feed direction 104 along respective directions intersecting the sheet feed direction 104. In other words, each of the first separation protrusions 61, 62 extends so as to be inclined relative to the sheet feed direction 104 as seen in a direction perpendicular to the inclined surface 26. The direction of extension of the first separation protrusions 61 and the direction of extension of the first separation protrusion 62 are symmetrical with respect to a position of the inclined surface 26 which is middle in the width direction 101 and which is the same as the position of the sheet supply roller 30 in the width direction 101. The first separation protrusions 61, 62 are arranged in a staggered fashion in the sheet feed direction 104. More specifically, any one of the first separation protrusions 61 is located at a position that is between corresponding adjacent two of the first separation protrusions 62 while any one of the first separation protrusions 62 is located at a position that is between corresponding adjacent two of the first separation protrusions 61.

Each of the second separation protrusions 52 is disposed such that any one of the second separation protrusions 52 is sandwiched between a corresponding one of the first separation protrusions 61 and a corresponding one of the first separation protrusions 62 disposed in the staggered fashion in the sheet feed direction 104 described above. When the layout of the first separation protrusions 61, 62 and the second separation protrusions 52 is explained focusing on the positions of the respective top ends of the first separation protrusions, 61, 62 and the second separation protrusions 52, it can be said that a sequence of one first separation protrusion 61, one second separation protrusion 52, and one first separation protrusion 62 is repeated in the sheet feed direction 104.

The first separation protrusions 61, 62 are disposed on opposite sides of the row of the second separation protrusions 52 in the width direction as described above, thereby decreasing the pitch at which the first separation protrusions 61, 62 and the second separation protrusions 52 are arranged in the sheet feed direction 104. Further, the extension direction of the first separation protrusion 61 and the extension direction of the first separation protrusion 62 intersect the sheet feed direction 104, thereby increasing a distance by which the leading edge of the recording sheet slides on each of the first separation protrusions 61, 62.

[Modifications]

In the modified embodiment of FIG. 5, the row of the first separation protrusions 61 and the row of the first separation protrusions 62 are provided respectively on the opposite sides of the row of the second separation protrusions 52 in the width direction 101. Only one of the row of the first separation protrusions 61 and the row of the first separation protrusions 62 may be provided on one of the opposite sides of the row of the second separation protrusions 52. Further, the respective extension directions of the first separation protrusions 61, 62 may be suitably changed as long as the extension directions intersect the sheet feed direction 104.

The inclined member 24 need not be formed integrally with the sheet cassette 20, provided that the inclined member 24 is disposed to face the leading edges of the recording sheets. Accordingly, the inclined member 24 may be provided on the printer 11 so as to be independently of the sheet cassette 20.

The shape of each of the first separation protrusions 61, 62 may be suitably changed. Moreover, the first separation protrusions 61 may not overlap each other in the sheet feed direction 104 and the first separation protrusions 62 may not overlap each other in the sheet feed direction 104, as long as each of the first separation protrusions 61, 62 is disposed so as to be located intermediate between corresponding adjacent two second separation protrusions 52.

The protrusion amount L1 of the first separation protrusions 51 and the protrusion amount L2 of the second separation protrusions 52 may be suitably determined respectively depending upon the rigidity of the first separation protrusions 51 and the rigidity of the second separation protrusions 52, etc. For instance, the protrusion amount L1 and the protrusion amount L2 may be equal to each other (L1=L2), or the protrusion amount L2 may be larger than the protrusion amount L1 (L1<L2).

It is to be understood that the present invention may be otherwise embodied with various changes and modifications, which may occur to those skilled in the art, without departing from the scope of the invention defined in the attached claims.

What is claimed is:

1. A sheet feeder, comprising:

a holding portion having a holding surface on which a plurality of sheets are held in a stack;

a supply portion configured to supply the plurality of sheets sequentially first from an uppermost one of the plurality of sheets held on the holding portion;

an inclined member disposed downstream of the holding portion in a direction in which the sheets are supplied by the supply portion and having an inclined surface that faces a leading edge of each of the sheets held on the holding portion while inclining relative to the holding surface, the inclined member being configured to guide said each of the sheets supplied from the holding portion in a sheet feed direction in which said each of the sheets is fed along the inclined surface;

a plurality of first separation protrusions which are provided on and integrally with the inclined member and each of which protrudes from the inclined surface such that a distal end thereof is located more downstream in the sheet feed direction than a proximal end thereof, the plurality of first separation protrusions being arranged in the sheet feed direction; and a plurality of second separation protrusions which are formed of a metal and each of which protrudes from the inclined surface through a corresponding one of openings that is formed in the inclined member at a position in the sheet feed direction between corresponding adjacent two of the plurality of first separation protrusions, the plurality of second separation protrusions being arranged in the sheet feed direction, wherein each of the plurality of second separation protrusions is formed such that a distal end thereof is located more downstream in the sheet feed direction than a proximal end thereof.

2. The sheet feeder according to claim 1, comprising a metal plate member disposed on a surface of the inclined member opposite to the inclined surface and having a plurality of protruding portions, wherein the plurality of protruding portions serve as the plurality of second separation protrusions by protruding from the inclined surface through the respective openings.

3. The sheet feeder according to claim 1, wherein each of the first separation protrusions is configured to be elastically deformed by being pushed by any of the sheets that is fed.

4. The sheet feeder according to claim 1, wherein each of the second separation protrusions is configured to be elastically deformed by being pushed by any of the sheets that is fed.

5. The sheet feeder according to claim 1, wherein each of the plurality of first separation protrusions protrudes from the inclined surface such that the distal end of one of the plurality of first separation protrusions is located more downstream in the sheet feed direction than the proximal end of another of the plurality of first separation protrusions that is located immediately downstream of the one of the plurality of first separation protrusions in the sheet feed direction.

6. The sheet feeder according to claim 1, wherein each of the plurality of first separation protrusions and each of the plurality of second separation protrusions are alternately arranged in a row in the sheet feed direction.

7. The sheet feeder according to claim 1, wherein a row of the plurality of first separation protrusions is located on one side of a row of the plurality of second separation protrusions in a sheet width direction of said each of the sheets that is fed.

8. The sheet feeder according to claim 7, wherein each of the plurality of first separation protrusions extends so as to be inclined relative to the sheet feed direction as seen in a direction perpendicular to the inclined surface.

9. The sheet feeder according to claim 1, wherein an amount of protrusion of each of the plurality of second separation protrusions from the inclined surface is smaller than an amount of protrusion of each of the plurality of first separation protrusions from the inclined surface.

10. The sheet feeder according to claim 1, wherein the inclined member and each of the first separation protrusions are formed of a synthetic resin.

11. The sheet feeder according to claim 1, wherein the supply portion includes: an arm provided so as to be pivotable in an upward and downward direction about a proximal end portion thereof; and a roller provided at a distal end portion of the arm and configured to be rotated while being in contact with the uppermost one of the plurality of sheets held on the holding portion.

12. An image recording apparatus, comprising:

the sheet feeder defined in claim 1; and a recording portion configured to record an image on said each of the sheets that is fed by the sheet feeder.

* * * * *